US007470200B2

(12) United States Patent
Sanchez

(10) Patent No.: US 7,470,200 B2
(45) **Date of Patent: *Dec. 30, 2008**

(54) GOLF CLUB HEAD FOR A HYBRID GOLD CLUB

(75) Inventor: Richard R. Sanchez, New River, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/941,727

(22) Filed: Nov. 16, 2007

(65) Prior Publication Data

US 2008/0070718 A1 Mar. 20, 2008

Related U.S. Application Data

(63) Continuation of application No. 11/193,081, filed on Jul. 29, 2005, now Pat. No. 7,316,624.

(51) Int. Cl.
*A63B 53/04* (2006.01)

(52) U.S. Cl. ..... 473/328; 473/345; 473/349

(58) Field of Classification Search ..... 473/324–350, 473/287–292, 219–256; D21/752, 759
See application file for complete search history.

(56) References Cited

U.S. PATENT DOCUMENTS

| | | | | |
|---|---|---|---|---|
| 1,269,745 | A | 6/1918 | Robertson | |
| 1,306,029 | A | 6/1919 | Robertson | |
| 1,525,352 | A | 2/1925 | Aitken | |
| 1,568,888 | A | 1/1926 | Dunn | |
| 1,617,090 | A * | 2/1927 | Worthington | 473/328 |
| D240,748 | S * | 7/1976 | Bock | D21/752 |
| 4,431,192 | A * | 2/1984 | Stuff, Jr. | 473/327 |
| 4,850,593 | A * | 7/1989 | Nelson | 473/328 |
| 4,900,029 | A * | 2/1990 | Sinclair | 473/327 |
| 5,094,383 | A | 3/1992 | Anderson et al. | |
| 5,184,823 | A | 2/1993 | Desboilles | |
| D344,117 | S | 2/1994 | Helmstetter et al. | |
| 5,310,186 | A | 5/1994 | Karsten | |
| RE34,925 | E | 5/1995 | McKeighen | |
| D363,750 | S | 10/1995 | Reed | |
| 5,755,624 | A | 5/1998 | Helmstetter | |

(Continued)

FOREIGN PATENT DOCUMENTS

| | | |
|---|---|---|
| JP | 2004008810 | 9/2001 |

(Continued)

*Primary Examiner*—Sebastiano Passaniti
(74) *Attorney, Agent, or Firm*—Darrell F. Marquette

(57) ABSTRACT

A golf club head includes a heel end, a toe end, a front wall arranged for impacting a golf ball, and a crown extending between the heel and toe ends. The crown has a front portion and a rear portion. A sole extends between the heel and toe ends and extends between the front wall and the crown rear portion. The sole includes a primary portion and a relief portion. The sole relief portion extends rearwardly away from the front wall and upwardly toward the crown rear portion when the sole primary portion is positioned on a substantially horizontal surface. The sole relief portion may vary in thickness and may include a weight pad. The golf club head may have a hollow interior cavity with the crown curving inwardly toward the cavity between its front and rear portions.

26 Claims, 2 Drawing Sheets

U.S. PATENT DOCUMENTS

| | | | | |
|---|---|---|---|---|
| 5,954,596 | A | 9/1999 | Noble et al. | |
| 6,168,537 | B1 | 1/2001 | Ezawa | |
| 6,319,148 | B1 * | 11/2001 | Tom | 473/290 |
| 6,398,666 | B1 | 6/2002 | Evans et al. | |
| 6,551,200 | B1 | 4/2003 | Golden et al. | |
| 6,604,568 | B2 | 8/2003 | Bliss et al. | |
| 6,623,374 | B1 | 9/2003 | Helmstetter et al. | |
| 6,652,391 | B1 | 11/2003 | Kubica et al. | |
| 6,676,535 | B2 | 1/2004 | Sheets et al. | |
| 6,695,714 | B1 | 2/2004 | Bliss et al. | |
| 6,719,645 | B2 | 4/2004 | Kouno | |
| 6,743,118 | B1 | 6/2004 | Soracco | |
| 6,776,723 | B2 | 8/2004 | Bliss et al. | |
| D498,507 | S | 11/2004 | Gamble | |
| 6,863,624 | B1 | 3/2005 | Kessler | |
| 2005/0026720 | A1 | 2/2005 | Willet et al. | |

FOREIGN PATENT DOCUMENTS

| | | |
|---|---|---|
| JP | 2005130935 | 5/2005 |
| JP | 2005137788 | 6/2005 |

* cited by examiner

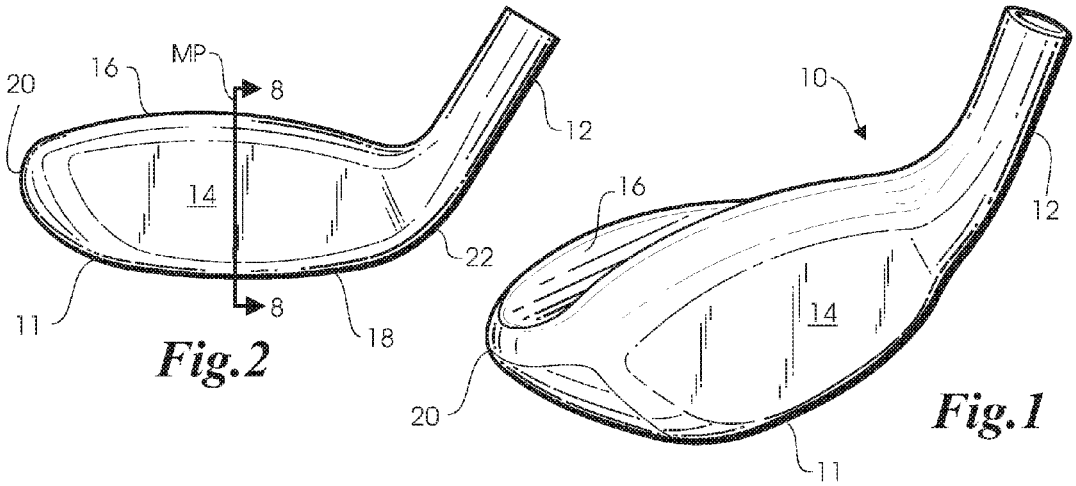
Fig.2
Fig.1
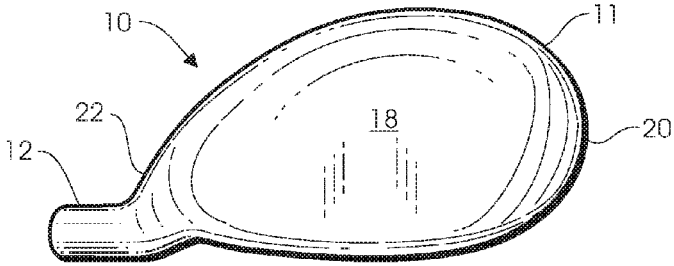
Fig.3
Fig.6
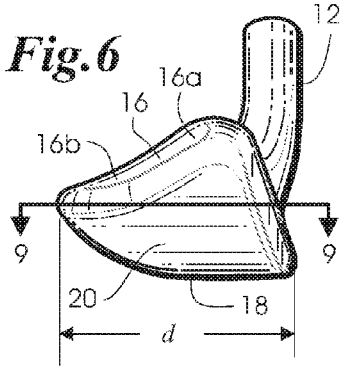
Fig.4
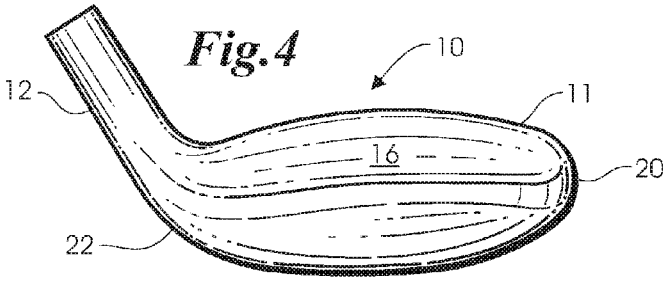
Fig.5
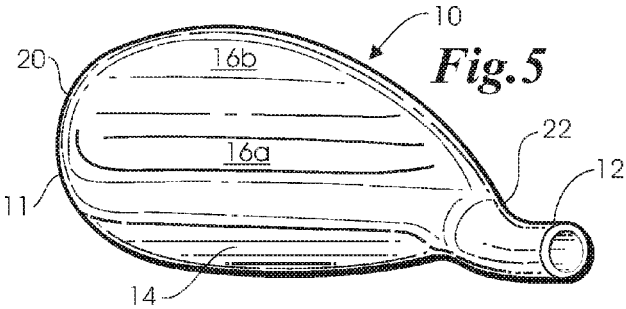
Fig.7
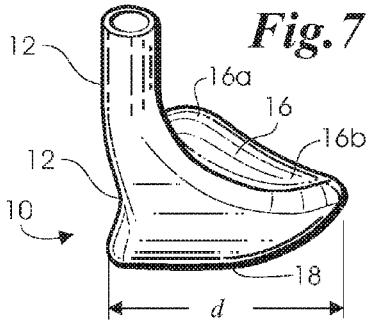

GOLF CLUB HEAD FOR A HYBRID GOLD CLUB

This is a continuation of application Ser. No. 11/193,081 filed Jul. 29, 2005, now U.S. Pat. No. 7,316,624.

BACKGROUND OF THE INVENTION

The present invention relates generally to golf equipment and, in particular, to a golf club head for a hybrid golf club.

Modern golf clubs have typically been classified as woods, irons, and putters. Recently, a new class of golf clubs has emerged that combine many of the features and benefits of both woods and irons. These newer club types are commonly referred to as "hybrid" clubs, utility clubs, or iron-wood clubs. Such hybrid clubs are used in many instances in lieu of low lofted irons or high lofted fairway woods.

One desired attribute of a golf club, including hybrid clubs, is to have the center of gravity of the golf club head positioned away from the face and down toward the sole. Locating the center of gravity of the club head in such a fashion improves the launch angle of a golf ball struck by the club. In addition, a golf club head with a lower center of gravity tends to impart less back spin to a golf ball during impact, thus improving the likelihood that the golf ball will travel a greater distance.

Another desired attribute of hybrid clubs is to enhance the ability of the club to easily be swung through and make solid contact with a golf ball that is lying in the rough or tall grass. In many instances, when a player using a conventional club attempts to hit a golf ball lying in tall grass, the club head will get caught up in the grass, will slow down and will not make contact with the golf ball in the preferred location on the face of the club head.

SUMMARY OF THE INVENTION

The present invention is directed a golf club head that includes a body having a heel end, a toe end, a front wall arranged for impacting a golf ball, and a crown extending between the heel and toe ends. The crown has a front portion and a rear portion. A sole extends between the heel and toe ends and extends between the front wall and the crown rear portion. In an illustrative embodiment, the sole includes a primary portion and a relief portion. The sole relief portion extends rearwardly away from the front wall and upwardly toward the crown rear portion when the sole primary portion is positioned on a substantially horizontal surface. The sole relief portion may extend at least one half of a depth dimension of the sole as measured on the horizontal surface and along a midplane of the body. The midplane of the body is perpendicular to the horizontal surface, perpendicular to the front wall and intersects the body midway between the heel and toe ends.

In the illustrative embodiment described above, the sole relief portion may include a weight pad that varies in thickness from a first thickness that is substantially equal to a generally constant thickness of the sole primary portion to a second thickness that is greater than the first thickness. The sole relief portion may also vary in thickness from the second thickness to a third thickness that is less than the second thickness. The first thickness is located at a first transition region between the sole primary portion and the sole relief portion. The third thickness is located a second transition region between the sole relief portion and the crown rear portion. The second thickness is located between the first and second transition regions.

DESCRIPTION OF THE DRAWINGS

FIG. 1 is a perspective view of a golf club head;

FIG. 2 is a front elevation view of the golf club head shown in FIG. 1;

FIG. 3 is bottom view of the golf club head shown in FIG. 1;

FIG. 4 is rear elevation view of the golf club head shown in FIG. 1;

FIG. 5 is a top plan view of the golf club head shown in FIG. 1;

FIG. 6 is a toe end view of the golf club head shown in FIG. 1;

FIG. 7 is a heel end view of the golf club head shown in FIG. 1;

DESCRIPTION OF THE INVENTION

Figure 8:
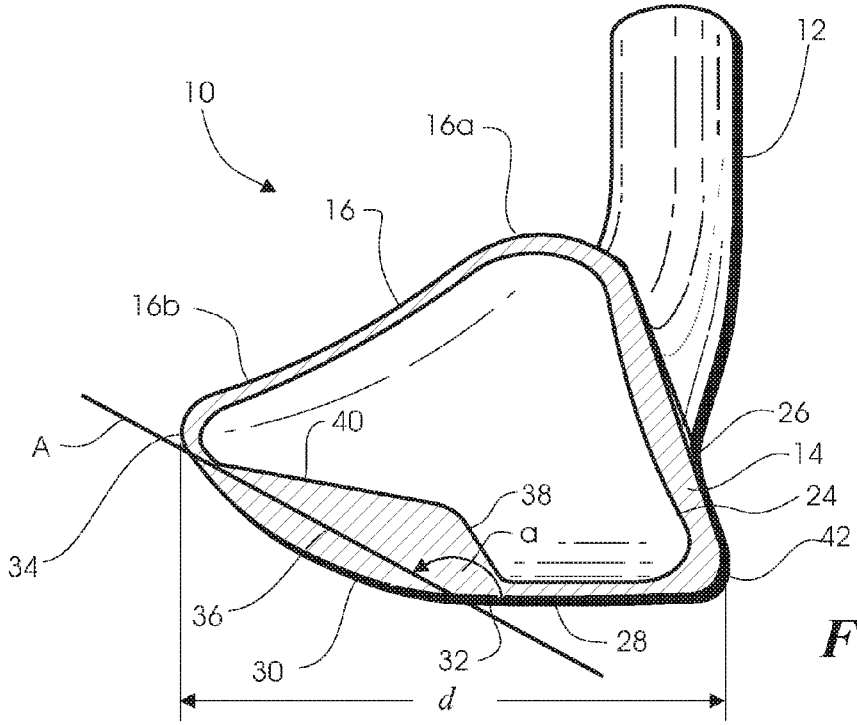
FIG. 8 is a cross-sectional view of the golf club head taken along line 8-8 in FIG. 2.

Referring to FIGS. 1-7, a golf club head 10 includes a generally hollow body 11 with an integral hosel 12 configured to accept a golf club shaft. The head 10 may be formed from a suitable metal such as, for example stainless steel or titanium alloys. The head 10 includes a front wall 14 arranged for impacting a golf ball, a crown 16 and a sole 18. Further, the body 11 has a toe end 20 opposite a heel end 22 located nearest the hosel 12. The crown 16 extends between the toe end 20 and the heel end 22 and includes a front portion **16*a* adjacent the front wall 14 and a rear portion 16*b* located rearwardly of the front portion 16*a*. The crown rear portion 16*b* curves in a direction toward the front wall 14 as it transitions into both the toe end 20 and the heel end 22. As described in further detail below, the crown 16 curves inwardly toward the hollow interior of the body 11 between its front and rear portions 16*a*, 16*b*. The head 10 is preferably constructed such that the hosel 12, the front wall 14, the crown 16, the sole 18, the toe end 20 and the heel end 22 may be integrally formed. Alternatively, these various elements that combine to form the head 10** may be separately molded, cast, forged or otherwise manufactured and assembled into a complete head using conventional means.

The front wall 14 may have a suitable loft angle for a hybrid club, such as between 15 and 25 degrees. The hosel 12 may be offset so that the lie angle of a golf club incorporating the head 10 may vary from about 58 to 61 degrees. The head 10 preferably has a weight in a range of about 220 to about 245 grams and may have an interior volume in a range of about 90 to about 100 cubic centimeters.

The toe end 20 of the head 10 is generally rounded between the front wall 14, the crown 16 and the sole 18. Similarly, the heel end 22 is generally rounded between the front wall 14, the crown 16 and the sole 18 and transitions into the hosel 12.

Figure 9:
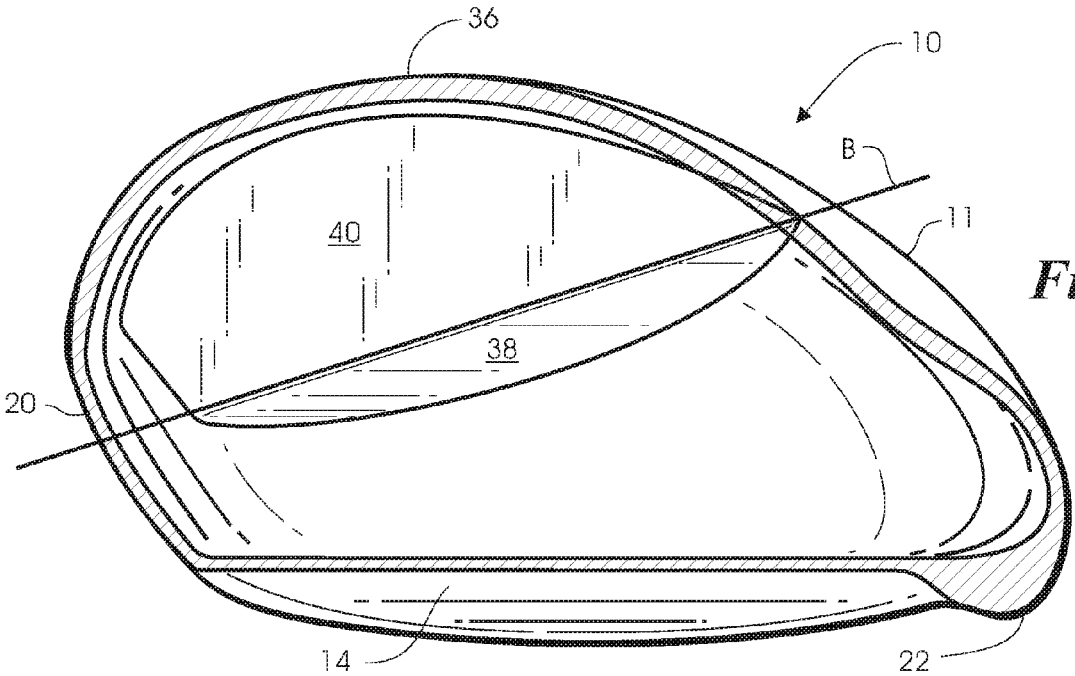
FIG. 9 is a cross-sectional view of the golf club head taken along line 9-9 in FIG. 6.

Referring to FIGS. 8 and 9, the front wall 14 may include a face insert (not shown), which may be formed from the same or a different material than the remainder of the head 10. The face insert may be welded into or otherwise attached to the head 10 using conventional means. The face insert, or the front wall 14 if a face insert is not used, may vary in thickness. Thus, the front wall 14 may have a thickness measured between its inner and outer surfaces 24 and 26, with a maximum thickness near its geometric center. In this embodiment, the front wall 14 may vary in thickness in a generally horizontal plane that is disposed between the crown 16 and the sole 18. The front wall 14 may also vary in thickness in a generally vertical plane that is disposed between the toe and heel ends 20 and 22. For example, the thickness of the front wall 14 at its geometric center may vary from about 0.111 to about 0.119 inches, while the thickness of the front wall 14 at its perimeter may vary from about 0.081 to about 0.089 inches in thickness. The bulge radius of the front wall 14, i.e., the curvature of the front wall 14 from its top edge (where the front wall 14 meets the crown 16) to its bottom edge (where the front wall 14 meets the sole 18) may vary from about 12.5 to about 14.5 inches. The roll radius of the front wall 14, i.e., the curvature of the front wall 14 from the toe end 20 to the heel end 22, may also vary from about 12.5 to about 14.5 inches.

The sole 18 is curved between the toe end 20 and the heel end 22. The sole 18 may have a primary portion 28 and a relief portion 30. As best illustrated in FIG. 8, the primary portion 28 of the sole 18 is generally planar and is located forward of the sole relief portion 30 toward the front wall 14. The angle between the sole primary portion 28 and the forward wall 14 is known as the loft angle of the club head 10. The sole primary portion 28 has a generally constant thickness of about 0.125 inch.

The sole relief portion 30 extends rearwardly away from the front wall 14 and upwardly toward the crown rear portion 16*b* when the sole primary portion 28 is positioned on a substantially horizontal surface such as the ground. The sole relief portion 30 extends from a first transition region 32 located at a rear extremity of the sole primary portion 28 to a second transition region 34 located near the crown rear portion 16*b*. Referring to FIG. 2, a midplane MP is shown cutting though the body 11 along line 8-8. The midplane MP is perpendicular to the horizontal surface upon which the sole primary portion 28 rests, perpendicular to the front wall 18, and intersects the body 11 midway between the toe end 20 and the heel end 22. As illustrated in FIG. 8, the sole relief portion 30 extends at least one half of a depth dimension d of the sole 18 as measured along the horizontal surface along the midplane MP. The depth dimension d is preferably between 2.00 and 2.40 inches.

The radius of curvature of the sole relief portion 30 is preferably at least 1.30 inches, more preferably 1.40 inches to 1.70 inches, and even more preferably 1.55 inches to 1.65 inches.

The sole relief portion 30 may be further defined by an angle $\alpha$ between the sole primary portion 28 at the midplane MP and another plane represented by line A in FIG. 8 that intersects the sole primary portion 28 at the first transition region 32 that is between the sole primary portion 28 and the sole relief portion 30 and further intersects the second transition region 34 that is between the sole relief portion 30 and the crown rear portion 16*b*. Preferably, this angle $\alpha$ is between 140 degrees and 160 degrees and most preferably between 145 degrees and 155 degrees.

The sole relief portion 30 is preferably weighted to move the center of gravity of the head 10 lower and toward the rear of the head 10. In one embodiment, for example, as illustrated in FIGS. 8 and 9, the sole relief portion 30 includes a weight pad 36. The weight pad 36 may be an area of bulging thickness on the inside of the body 11 which, when viewed perpendicular to the midplane MP, tapers along the sole relief portion 30 from a first thickness that is substantially equal to the constant thickness of the sole primary portion 28 to a maximum thickness in a region near a midpoint of the sole relief portion 30. This maximum thickness of the sole relief portion 30 may be about 0.325 inch. The thickness of the sole relief portion 30 may then decrease to a second thickness, for example, about 0.050 inches, at the transition region 34 that is between the sole relief portion 30 and the crown rear portion 16*b*.

Referring to FIG. 9, in certain embodiments, the thickness of the weight pad 36 may also vary generally along the length of the sole relief portion 30, for example, along a further plane represented by a line B. In this direction, the thickness of the weight pad 36 may vary from the thickness of the sole primary portion 28, to a maximum thickness near a midpoint of the sole relief portion 30 along plane B, returning to a thickness approximately equal to the thickness of the transition region 34. Plane B may extend from a first area adjacent an intersection of the toe end 20, the sole primary portion 28 and the sole relief portion 30 to a second area adjacent an intersection of the heel end 22, the crown rear portion 16*b*, and the sole relief portion 30. Along plane B, the thickness of the sole relief portion 30 may be at its maximum along the midplane MP.

As illustrated in FIG. 9, the weight pad 36 generally extends along plane B from the approximate center of the toe section 22 along an angle that is not parallel with the front wall 14 in a direction toward the intersection of the heel end 20, the crown rear portion 16*b*, and the sole 18. The weight pad 36 includes a first sloped surface 38 and a second sloped surface 40. The slope of surface 38 may be about 45 degrees, while the slope of surface 40 may be about 5 degrees. Of course, the weight pad 36 may be formed in other shapes, slopes and dimensions and can be formed with a uniform thickness or with a taper having a different or non-uniform slope.

As illustrated in FIGS. 6-8, the crown 16 is inwardly curved between the front and rear crown portions 16*a* and 16*b* toward the hollow interior cavity of body 11. Providing an inwardly curved or concave crown 16 assists in moving the center of gravity of the head 10 further down toward the sole 18. The crown 16 may have a thickness that is about 0.026 to about 0.037 inches. The radius of curvature of the crown 16 may vary from about 3.30 inches to about 3.50 inches.

As illustrated in FIG. 8, the head 10 includes a third transition region 42 between the sole 18 and the front wall 14. The third transition region 42 may have a radius of about 0.15 inch. The head 10 also includes a second transition region 34 between the sole relief portion 30 and the crown rear portion 16*b*. The second transition region 34 may have a radius of about 0.20 inch.

The depth dimension d of the club head 10 from the third transition region 42 (i.e., the transition between the front wall 14 and the sole 18) to the second transition region 34 between the sole 18 and the crown rear portion 16*b* preferably ranges from about 0.65 inches to 0.85 inches, and is most preferably 0.79 inches. The height of the head 10 measured from the sole 18 to a fourth transition region between the crown front portion 16*a* and the front wall 14 preferably ranges from about 1.32 inches to 1.40 inches, and is most preferably 1.37 inches. The width of the head 10 from the toe end 20 to the heel end 22 preferably ranges from about 3.25 inches to 4.00 inches, and is most preferably 3.65 inches.

The configuration of the hybrid, utility, or iron-wood type golf club head described herein draws the center of gravity down toward the sole, away from the face of the club and toward the heel, enabling the club head to impart less back spin on the ball. In addition, the sole relief enhances the ability to smoothly move the club head through the rough. Moreover, the overall geometric shape of club head greatly enhances the aesthetics of the golf club.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A golf club head comprising:

a body having a heel end, a toe end, a front wall arranged for impacting a golf ball, and a crown extending between the heel and toe ends, the crown having a front portion and a rear portion;

the body also having a sole extending between the heel and toe ends and extending between the front wall and the crown rear portion, the sole including a primary portion and a relief portion;

the sole relief portion extending rearwardly away from the front wall and upwardly toward the crown rear portion when the sole primary portion is positioned on a substantially horizontal surface;

the sole having a depth dimension measured along the horizontal surface in a midplane that is perpendicular to the horizontal surface, perpendicular to the front wall and intersects the body midway between the heel and the toe ends;

the sole relief portion extending at least one half of the sole depth dimension;

the crown curving inwardly toward the sole between the crown front and rear portions, the sole relief portion varying in thickness from a first thickness at a first transition region that is substantially equal to a generally constant thickness of the sole primary portion to a second thickness that is greater than the first thickness and is located between the first transition region and a second transition region; and the sole relief portion varying in thickness along a diagonal plane that extends diagonally from a first area adjacent an intersection of the toe end, the sole primary portion and the sole relief portion to a second area adjacent an intersection of the heel end, the crown rear portion and the sole relief portion.

2. The golf club head of claim 1, wherein the sole relief portion has a radius of curvature of at least 1.60 inches.

3. The golf club head of claim 1, further comprising:

the first transition region being located between the sole primary portion and the sole relief portion; and the second transition region being located between the sole relief portion and the crown rear portion.

4. The golf club head of claim 1, wherein the sole relief portion further varies in thickness from the second thickness to a third thickness at the second transition region that is less than the second thickness.

5. The golf club head of claim 1, wherein the second thickness of the sole relief portion is at its maximum at an intersection of the midplane and the diagonal plane.

6. The golf club head of claim 1, wherein the sole relief portion further varies in thickness along the midplane.

7. The golf club head of claim 1, wherein the sole relief portion includes a weight pad.

8. The golf club head of claim 1, wherein the sole relief portion varies in thickness.

9. The golf club head of claim 1, wherein the sole is curved between the toe end and the heel end.

10. The golf club head of claim 1, wherein the toe end is curved between the sole and the crown.

11. The golf club head of claim 1, wherein the heel end is curved between the sole and the crown.

12. The golf club head of claim 1, wherein:

the front wall has a geometric center and a peripheral region: and the front wall varies in thickness from a maximum thickness dimension located near the geometric center of the front wall to a minimum thickness dimension located in the peripheral region of the front wall.

13. The golf club head of claim 1, wherein the body has a hollow interior cavity, and wherein the crown curves inwardly toward the cavity between the crown front and rear portions.

14. The golf club head of claim 1 wherein the crown has a radius of curvature that varies between 3.30 inches and 3.50 inches.

15. The golf club head of claim 14, wherein the crown has a thickness between about 0.026 and 0.037 inch.

16. A golf club head comprising:

a body having a heel end, a toe end, a front wall arranged for impacting a golf ball, and a crown extending between the heel and toe ends, the crown having a front portion and a rear portion;

the body also having a sole extending between the heel and toe ends and extending between the front wall and the crown rear portion, the sole including a primary portion and a sole relief portion, the sole primary portion extending rearwardly away from the front wall and upwardly toward the crown rear portion when the sole primary portion is positioned on a substantially horizontal surface, the sole primary portion being located forward of the sole relief portion toward the front wall;

the sole relief portion varying in thickness from a first thickness substantially equal to a thickness of the sole primary portion to a second thickness that is greater than the first thickness;

the crown curving inwardly toward the sole between the crown front and rear portions; and the sole relief portion varying in thickness along a diagonal plane that extends diagonally from a first area adjacent an intersection of the toe end, the sole plate and the sole relief portion to a second area adjacent an intersection of the heel end, the rear crown portion, and the sole relief portion.

17. The golf club head of claim 16, wherein the sole relief portion further varies in thickness from the second thickness to a third thickness that is less than the second thickness.

18. The golf club head of claim 16, wherein:

the second thickness of the sole relief portion is at its maximum at an intersection of a midplane of the body and the diagonal plane; and the midplane of the body being perpendicular to the horizontal surface, perpendicular to the front wall and intersecting the body midway between the heel and the toe ends.

19. The golf club head of claim 18, wherein the sole relief portion further varies in thickness along the midplane.

20. The golf club head of claim 16, wherein the crown has a radius of curvature that varies between 3.30 inches and 3.50 inches.

21. The golf club head of claim 20, wherein the crown has a thickness between about 0.026 and 0.037 inch.

22. A golf club head comprising:

a body having a heel end, a toe end, a front wall arranged for impacting a golf ball, and a crown extending between the heel and toe ends, the crown having a front portion and a rear portion;

the body also having a sole extending between the heel and toe ends and extending between the front wall and the crown rear portion, the sole including a primary portion and a relief portion;

the sole relief portion extending rearwardly away from the front wall and upwardly toward the crown rear portion when the sole primary portion is positioned on a substantially horizontal surface; and the sole relief portion varying a thickness along a diagonal plane that extends diagonally from a first area adjacent an intersection of the toe end, the sole primary portion and the sole relief portion to a second area adjacent an intersection of the heel end, the crown rear portion and the sole relief portion.

23. The golf club head of claim 22, further comprising:

a first transition region between the sole primary portion and the sole relief portion;

a second transition region between the sole relief portion and the crown rear portion;

the sole primary portion having a generally constant thickness; and the sole relief portion varying in thickness from a first thickness at the first transition region that is substantially equal to the generally constant thickness of the sole primary portion to a second thickness that is greater than the first thickness and is located between the first and second transition regions.

24. The golf club head of claim 23, wherein the sole relief portion further varies in thickness from the second thickness to a third thickness at the second transition region that is less than the second thickness.

25. A golf club head comprising:

a body having a heel end, a toe end, a front wall arranged for impacting a golf ball, and a crown extending between the heel and toe ends, the crown having a front portion and a rear portion;

the body also having a sole extending between the heel and toe ends and extending between the front wall and the crown rear portion, the sole including a primary portion and a sole relief portion, the sole primary portion extending rearwardly away from the front wall and upwardly toward the crown rear portion when the sole primary portion is positioned on a substantially horizontal surface, the sole primary portion being located forward of the sole relief portion toward the front wall;

the sole relief portion varying a thickness from a first thickness substantially equal to a thickness of the sole primary portion to a second thickness that is greater than the first thickness; and the sole relief portion varying in thickness along a diagonal plane that extends diagonally from a first area adjacent an intersection of the toe, the sole plate and the sole relief portion to a second area adjacent an intersection of the heel, the rear crown portion, and the sole relief portion.

26. The golf club head of claim 25, wherein the sole relief portion further varies in thickness from the second thickness to a third thickness that is less than the second thickness.

* * * * *

UNITED STATES PATENT AND TRADEMARK OFFICE

CERTIFICATE OF CORRECTION

PATENT NO. : 7,470,200 B2
APPLICATION NO. : 11/941727
DATED : December 30, 2008
INVENTOR(S) : Richard R. Sanchez It is certified that error appears in the above-identified patent and that said Letters Patent is hereby corrected as shown below:

On the Title Page,

In the title, the word "GOLD" should be -- GOLF --.

Signed and Sealed this

Twenty-fourth Day of February, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,470,200 B2
APPLICATION NO. : 11/941727
DATED : December 30, 2008
INVENTOR(S) : Richard R. Sanchez It is certified that error appears in the above-identified patent and that said Letters Patent is hereby corrected as shown below:

On the Title Page, Item (54) and Column 1, line 1

In the title, the word "GOLD" should be -- GOLF --.

This certificate supersedes the Certificate of Correction issued February 24, 2009.

Signed and Sealed this

Seventeenth Day of March, 2009

JOHN DOLL
*Acting Director of the United States Patent and Trademark Office*